US008083317B2

(12) United States Patent
Omata et al.

(10) Patent No.: US 8,083,317 B2
(45) Date of Patent: Dec. 27, 2011

(54) LIQUID-DISCHARGING RECORDING HEAD

(75) Inventors: Koichi Omata, Kawasaki (JP); Yoshiyuki Imanaka, Kawasaki (JP); Hideo Tamura, Kawasaki (JP); Takaaki Yamaguchi, Yokohama (JP); Kousuke Kubo, Yokohama (JP); Ryoji Oohashi, Yokohama (JP); Yuuji Tamaru, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 386 days.

(21) Appl. No.: 12/482,321

(22) Filed: Jun. 10, 2009

(65) Prior Publication Data

US 2009/0309925 A1 Dec. 17, 2009

(30) Foreign Application Priority Data

Jun. 13, 2008 (JP) ..... 2008-155355

(51) Int. Cl.

| | |
|---|---|
| ***B41J 2/15*** | (2006.01) |
| ***B41J 2/145*** | (2006.01) |
| ***B41J 2/135*** | (2006.01) |
| ***B41J 2/015*** | (2006.01) |
| ***B41J 2/14*** | (2006.01) |
| ***B41J 2/16*** | (2006.01) |
| ***B41J 2/05*** | (2006.01) |

(52) U.S. Cl. ..... 347/40; 347/44; 347/20; 347/41; 347/50; 347/58

(58) Field of Classification Search ..... None
See application file for complete search history.

(56) References Cited

U.S. PATENT DOCUMENTS 5,696,544 A * 12/1997 Komuro ..... 347/50
7,216,960 B2 * 5/2007 Imanaka et al. ..... 347/58

FOREIGN PATENT DOCUMENTS

JP 07-276643 A 10/1995
JP 2005-138428 A 6/2005

* cited by examiner

*Primary Examiner* — Matthew Luu
*Assistant Examiner* — Renee Wilson

(57) ABSTRACT

A liquid-discharging recording head includes first and second substrates each having an energy generating element and a supply port, and a support member on which the substrates are arranged. The first substrate is provided on one side in a longitudinal direction of the support member, and the second substrate is provided on an other side in the longitudinal direction of the support member. A driving circuit configured to drive the energy generating element is provided in a larger region between an end of a supply port in the first substrate on the other side in the longitudinal direction and an end of the first substrate on the other side and in a larger region between an end of a supply port in the second substrate on the one side in the longitudinal direction and an end of the second substrate on the one side.

7 Claims, 14 Drawing Sheets

| INPUT ORDER | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| CONTENTS | DATA0 | DATA1 | DATA2 | DATA3 | DATA4 | DATA5 | DATA6 | DATA7 | DATA8 | DATA9 | DATA10 | DATA11 | DATA12 | DATA13 | DATA14 | DATA15 | BE0 | BE1 | BE2 | BE3 |

FIG. 8

| | DECODER INPUT | | | | DECODER OUTPUT | | | | | | | | | | | | | | | |
|---|---|---|---|---|---|---|---|---|---|---|---|---|---|---|---|---|---|---|---|---|
| CODE | BE3 | BE2 | BE1 | BE0 | BLE15 | BLE14 | BLE13 | BLE12 | BLE11 | BLE10 | BLE9 | BLE8 | BLE7 | BLE6 | BLE5 | BLE4 | BLE3 | BLE2 | BLE1 | BLE0 |
| 0 | L | L | L | L | L | L | L | L | L | L | L | L | L | L | L | L | L | L | L | H |
| 1 | L | L | L | H | L | L | L | L | L | L | L | L | L | L | L | L | L | L | H | L |
| 2 | L | L | H | L | L | L | L | L | L | L | L | L | L | L | L | L | L | H | L | L |
| 3 | L | L | H | H | L | L | L | L | L | L | L | L | L | L | L | L | H | L | L | L |
| 4 | L | H | L | L | L | L | L | L | L | L | L | L | L | L | L | H | L | L | L | L |
| 5 | L | H | L | H | L | L | L | L | L | L | L | L | L | L | H | L | L | L | L | L |
| 6 | L | H | H | L | L | L | L | L | L | L | L | L | L | H | L | L | L | L | L | L |
| 7 | L | H | H | H | L | L | L | L | L | L | L | L | H | L | L | L | L | L | L | L |
| 8 | H | L | L | L | L | L | L | L | L | L | L | H | L | L | L | L | L | L | L | L |
| 9 | H | L | L | H | L | L | L | L | L | L | H | L | L | L | L | L | L | L | L | L |
| 10 | H | L | H | L | L | L | L | L | L | H | L | L | L | L | L | L | L | L | L | L |
| 11 | H | L | H | H | L | L | L | L | H | L | L | L | L | L | L | L | L | L | L | L |
| 12 | H | H | L | L | L | L | L | H | L | L | L | L | L | L | L | L | L | L | L | L |
| 13 | H | H | L | H | L | L | H | L | L | L | L | L | L | L | L | L | L | L | L | L |
| 14 | H | H | H | L | L | H | L | L | L | L | L | L | L | L | L | L | L | L | L | L |
| 15 | H | H | H | H | H | L | L | L | L | L | L | L | L | L | L | L | L | L | L | L |

FIG. 9

| BE | INV | BE ⊻ INV |
|---|---|---|
| H | H | L |
| H | L | H |
| L | H | H |
| L | L | L |

LIQUID-DISCHARGING RECORDING HEAD

BACKGROUND OF THE INVENTION

1. Field of the Invention

The present invention relates to liquid-discharging recording heads for performing printing by discharging liquid, and more particularly, to an inkjet recording head for performing recording by discharging ink.

2. Description of the Related Art

In recording heads mounted in inkjet recording heads, electrothermal transducers (heaters) and driving circuits and lines therefor are typically formed on a substrate using a semiconductor process technique, as disclosed in Japanese Patent Laid-Open No. 2005-138428.

In recent years, inkjet recording apparatuses have been required to have a higher image quality and a higher recording speed. For that purpose, in substrates for inkjet recording heads, there are demands to increase the mount density of heaters and logic sections, to increase the number of arrays of nozzles in response to the increase in number of ink colors, and to increase the length of the nozzle arrays in response to the increase in number of heaters themselves.

The length of the recording head can be increased by a method disclosed in Japanese Patent Laid-Open No. 7-276643 in which a long recording head is formed by arranging a plurality of substrates in a predetermined direction.

The size of droplets to be discharged has recently been reduced further. For example, heaters and nozzles for discharging small droplets of 3 pl or less are sometimes arranged on a substrate at a high density (e.g., 600 dpi or more). When the length of the recording head becomes more than or equal to 1 inch (e.g., 2 inches), a flow-path forming member (orifice plate) tends to be easily peeled off the substrate by the influence of stress therebetween. Further, since the substrate and a support member supporting the substrate generally have different coefficients of linear expansion, the above-described peeling easily occurs through a heating process during mounting.

When two substrates each having a length of about one inch are arranged to be used as a recording head having a length of two inches, the influence of stress is reduced compared to an integrated substrate having a length of two inches. Therefore, the risk of peeling is reduced, and the production yield is improved. As a result, it is possible to enhance reliability of the head, to reduce the cost, and to enhance reliability as the product.

However, in the above-described head in which a plurality of substrates are arranged, the support member and a TAB (Tape Automated Bonding) serving as mounted components become relatively large, and this increases the cost.

Therefore, to reduce the cost of a long recording head in which a plurality of substrates are arranged, it is important to minimize the size of mounted components.

SUMMARY OF THE INVENTION

The present invention provides a long recording head in which a plurality of substrates are arranged on a support member and which can be reduced in size and cost by reducing the size of mounted components such as the support member and a TAB.

A liquid-discharging recording head according to an embodiment of the present invention includes two substrates each including an energy generating element configured to generate energy used to discharge liquid and a supply port configured to supply the liquid to the energy generating element; and a support member on which the substrates are arranged to extend along each other in a longitudinal direction. The substrates include a first substrate provided on one side of the support member in the longitudinal direction, and a second substrate provided on an other side of the support member opposite the one side in the longitudinal direction. A region of the first substrate on the other side overlaps with a region of the second substrate on the one side in a direction intersecting the longitudinal direction. A distance between an end of the supply port in the first substrate on the one side in the longitudinal direction and an end of the first substrate on the one side is smaller than a distance between an end of the supply port in the first substrate on the other side in the longitudinal direction and an end of the first substrate on the other side. A distance between an end of the supply port in the second substrate on the other side in the longitudinal direction and an end of the second substrate on the other side is smaller than a distance between an end of the supply port in the second substrate on the one side in the longitudinal direction and an end of the second substrate on the one side. A region between the end of the supply port in the first substrate on the other side in the longitudinal direction and the end of the first substrate on the other side and a region between the end of the supply port in the second substrate on the one side in the longitudinal direction and the end of the second substrate on the one side each includes a driving circuit configured to drive the energy generating element.

According to the embodiment of the present invention, it is possible to reduce the sizes of mounted components, and to thereby reduce the size and cost of the recording head.

Further features of the present invention will become apparent from the following description of exemplary embodiments with reference to the attached drawings.

BRIEF DESCRIPTION OF THE DRAWINGS

FIG. 8 is a table of decoder truth values in the first embodiment.

FIG. 9 is a table of BE and INV truth values in the first embodiment.

DESCRIPTION OF THE EMBODIMENTS

In this specification, the term "recording" is not limited to formation of significant information such as characters and graphics. In short, the term "recording" broadly includes formation of images, figures, patterns, and the like on a recording medium, or processing of the medium, regardless of whether they are significant or insignificant and whether they are visualized such as to be visually perceivable by humans. Also, the term "recording medium" not only includes paper used in common recording apparatuses, but also broadly includes materials capable of receiving ink, such as cloth, a plastic film, a metal plate, glass, ceramics, wood, and leather.

Further, the term "ink" (sometimes referred to as "liquid") should be broadly interpreted similarly to the definition of the above-described term "recording." That is, "ink" includes a liquid which, when applied onto a recording medium, can form images, figures, patterns, and the like, can process the recording medium, or can process ink (e.g., can solidify or insolubilize a coloring agent contained in ink applied to the recording medium).

Figure 1:
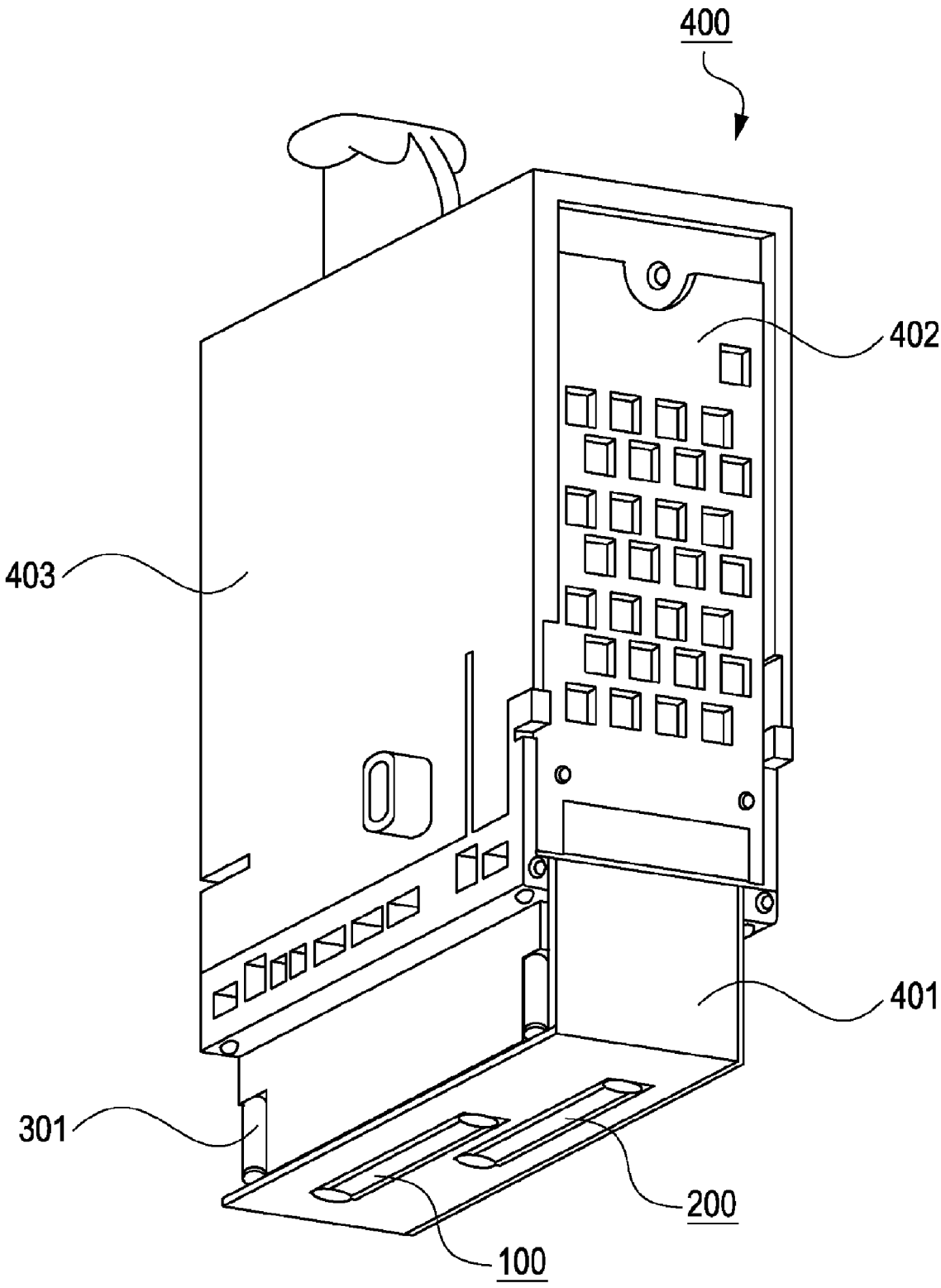
FIG. 1 is an overall view of a recording head according to a first embodiment of the present invention.

FIG. 1 is a perspective view of a liquid-discharging recording head according to a first embodiment of the present invention, that is, an inkjet recording head 400. In the first embodiment, the inkjet recording head 400 is a monochromatic head that achieves a printable area length of 1.7 inches with two substrates 100 and 200 each having a printable area length of 0.85 inch.

The recording head substrates 100 and 200 are chiefly formed of silicon. The substrates 100 and 200 are bonded to a support member 301 formed of alumina, and are attached to a sub-tank 403. Signal lines and power lines for the substrates 100 and 200 are connected to a printed circuit board 402 via a TAB 401. The printed circuit board 402 includes a plurality of contact pads, which are electrically connected to a connector of a carriage provided in an inkjet recording apparatus that will be described below.

Figure 2:
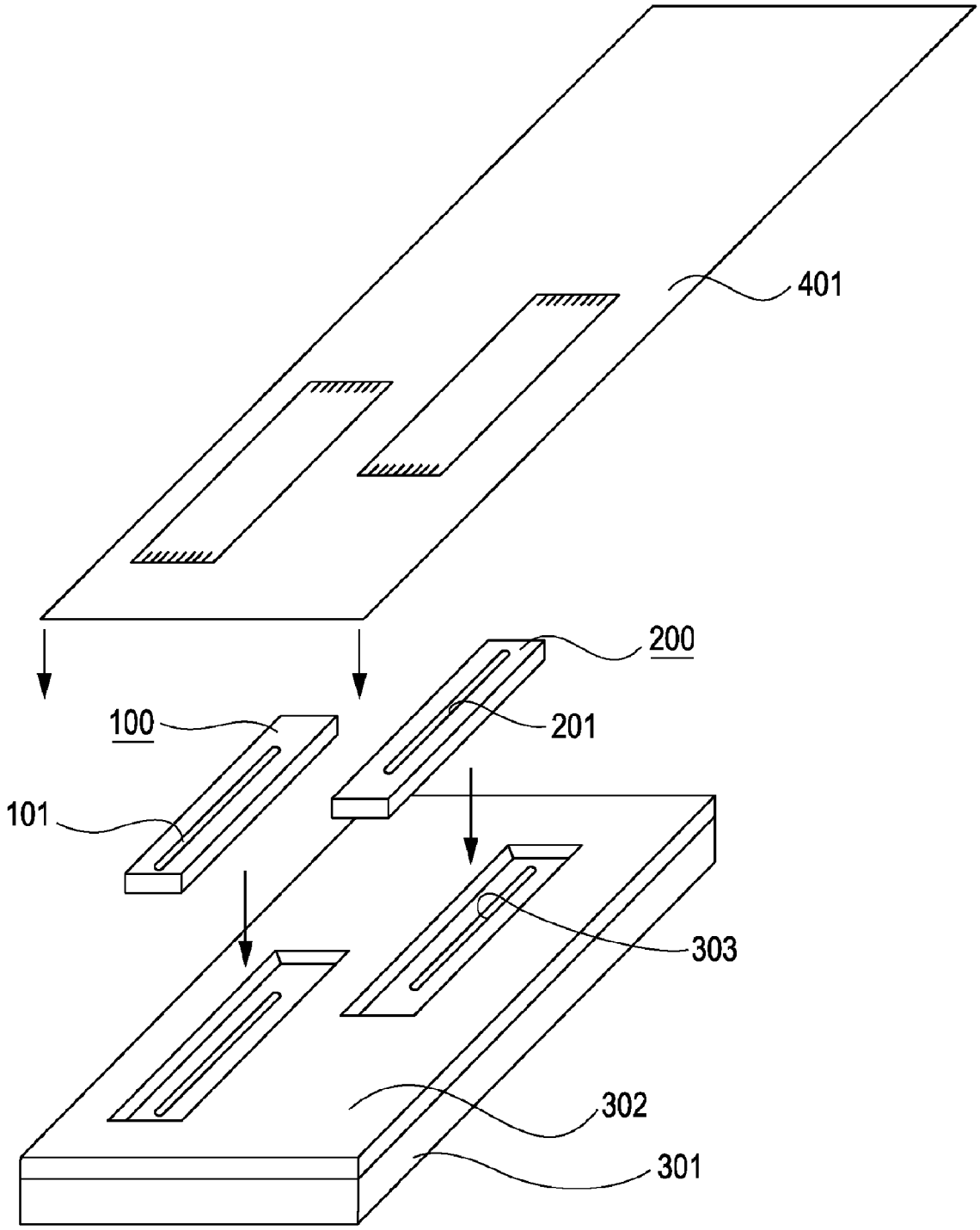
FIG. 2 is an exploded perspective view of the recording head of the first embodiment.
Figure 5A:
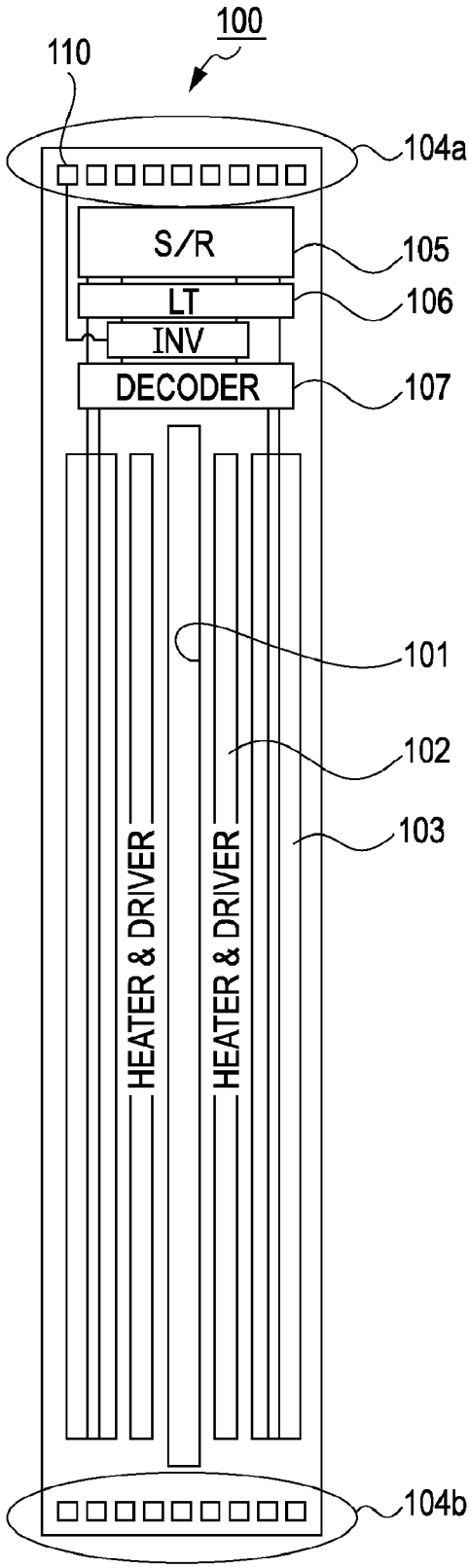
FIGS. 5A and 5B are schematic views showing the layout in a substrate in the first embodiment.

FIG. 2 illustrates bonding portions between the substrates 100 and 200 and the support member 301 in detail. FIG. 5A shows the layout in the substrate 100. Mounting of the substrates will be described below with reference to FIGS. 2 and 5A.

A second support member 302 is bonded to the support member 301. The support member 301 has ink supply openings 303 shaped like through holes, and bottom sides of the substrates 100 and 200 communicate with the sub-tank 403 so that ink is supplied from the sub-tank 403.

Since the substrates 100 and 200 are provided in openings of the second support member 302, the surface height of the substrates 100 and 200 is substantially equal to the surface height of the second support member 302. This allows inner leads of the TAB 401 to be easily connected to pads 104*a* and 104*b* of the substrates 100 and 200.

To produce the recording head 400, first, the support member 301 provided with the second support member 302 is prepared, and the substrates 100 and 200 are die-bonded into the openings of the second support member 302. Then, the TAB 401 is bonded onto the second support member 302, and the inner leads of the TAB 401 are connected to the pads 104*a* and 104*b* of the substrates 100 and 200. Subsequently, the support member 301 is joined to the sub-tank 403, the TAB 401 and the printed circuit board 402 are connected, and the printed circuit board 402 is attached to the sub-tank 403 by caulking, so that the recording head 400 is completed.

The layout in the substrate 100 will now be described with reference to FIG. 5A.

While an ink supply port 101 is, in general, provided in the center of the substrate 100, that is, at a vertically and horizontally symmetrical position, an opening of the ink supply port 101 is provided at a position offset toward one longitudinal side of the substrate 100 in the first embodiment. An area 102 in which an array of energy generating elements (heaters) for generating energy used to discharge liquid and drivers for driving the heaters are arranged is provided on each side of the supply port 101. On outer sides of the areas 102, selection circuits 103 are provided to select the energy generating elements. The substrate 100 also includes driving circuits serving as main circuit components, for example, a shift register (S/R) 105, a latch circuit (LT) 106, and a decoder 107. These driving circuits are provided on the upper side in FIG. 5A, that is, on a side where a region between the longitudinal end of the ink supply port 101 and the longitudinal end of the substrate 100 is larger.

Figure 6:
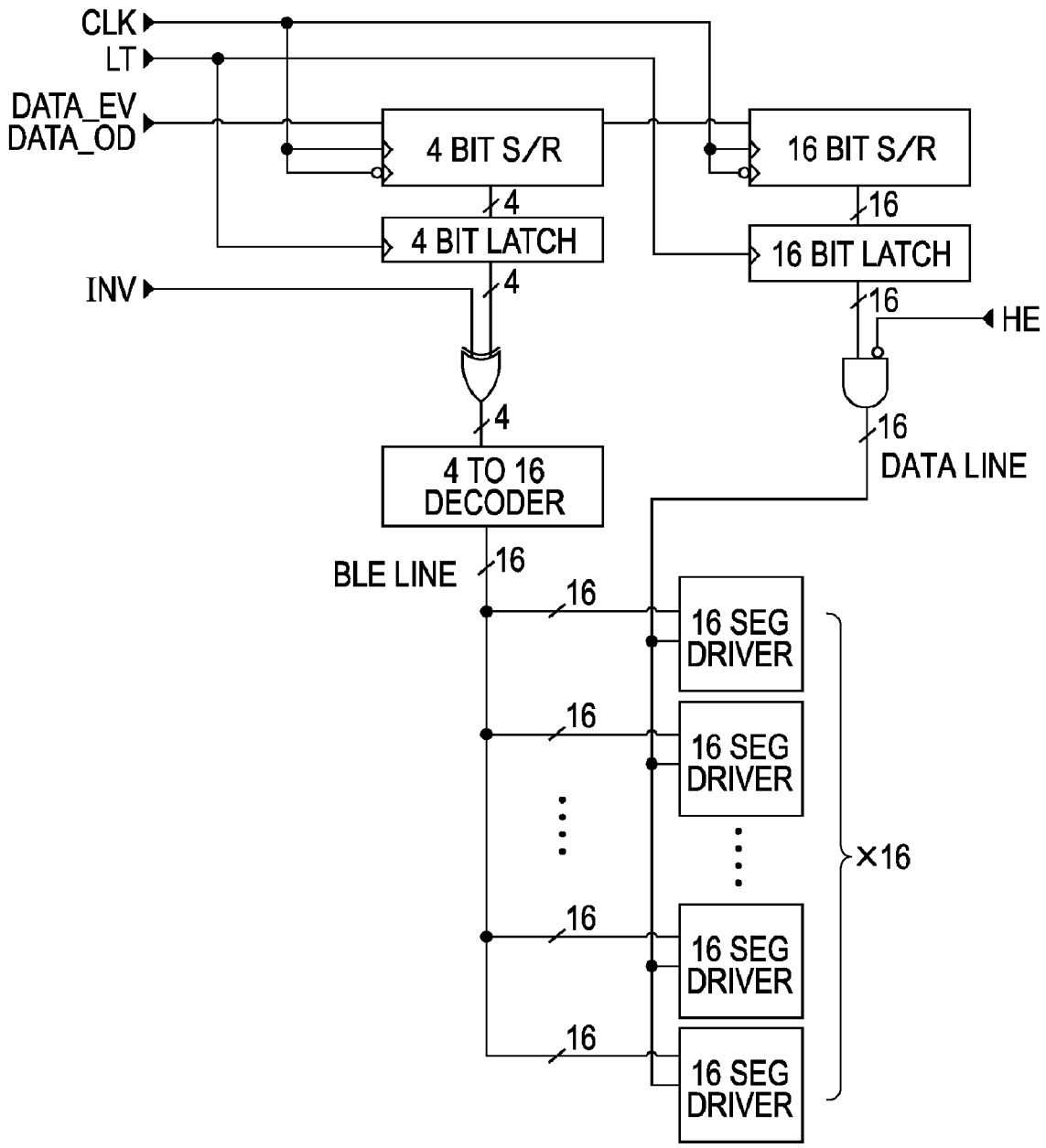
FIG. 6 is a block diagram of a circuit in the substrate in the first embodiment.
Figure 7:
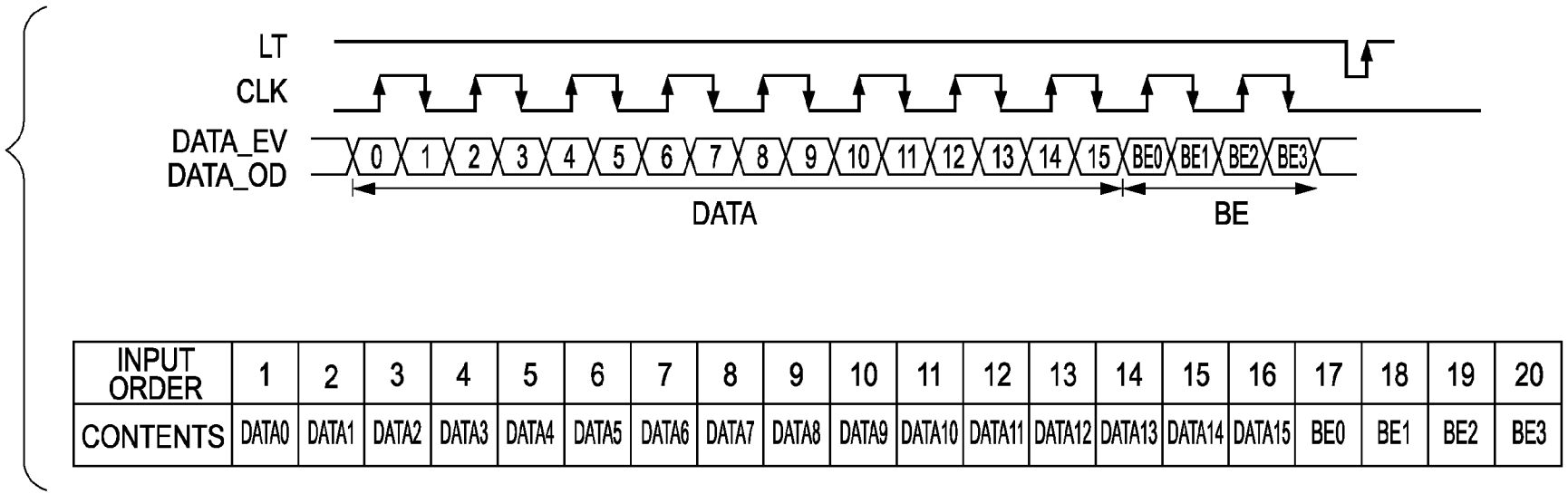
FIG. 7 shows the order of DATA signals in the first embodiment.

FIG. 6 is a block diagram of a circuit for driving heaters arranged on one lateral side of the ink supply port. In the first embodiment, 256 heaters are arranged on one side of the ink supply port, and are driven in 16 time divisions. Here, 20 bits of data shown in FIG. 7 are input to the S/R 105 via DATA_EV or DATA_OD. The first 16 bits of the input data are DATA signals DATA0 to DATA15 for selecting any of adjacent units of 16 segments. The last four bits of the input data are BE signals BE0 to BE3 for generating block selection signals BLE that select any of 16 blocks by which driving is performed. The four bits of data BE0 to BE3 are decoded into 16 time division signals BLE0 to BLE15, as shown in FIG. 8.

Figure 10:
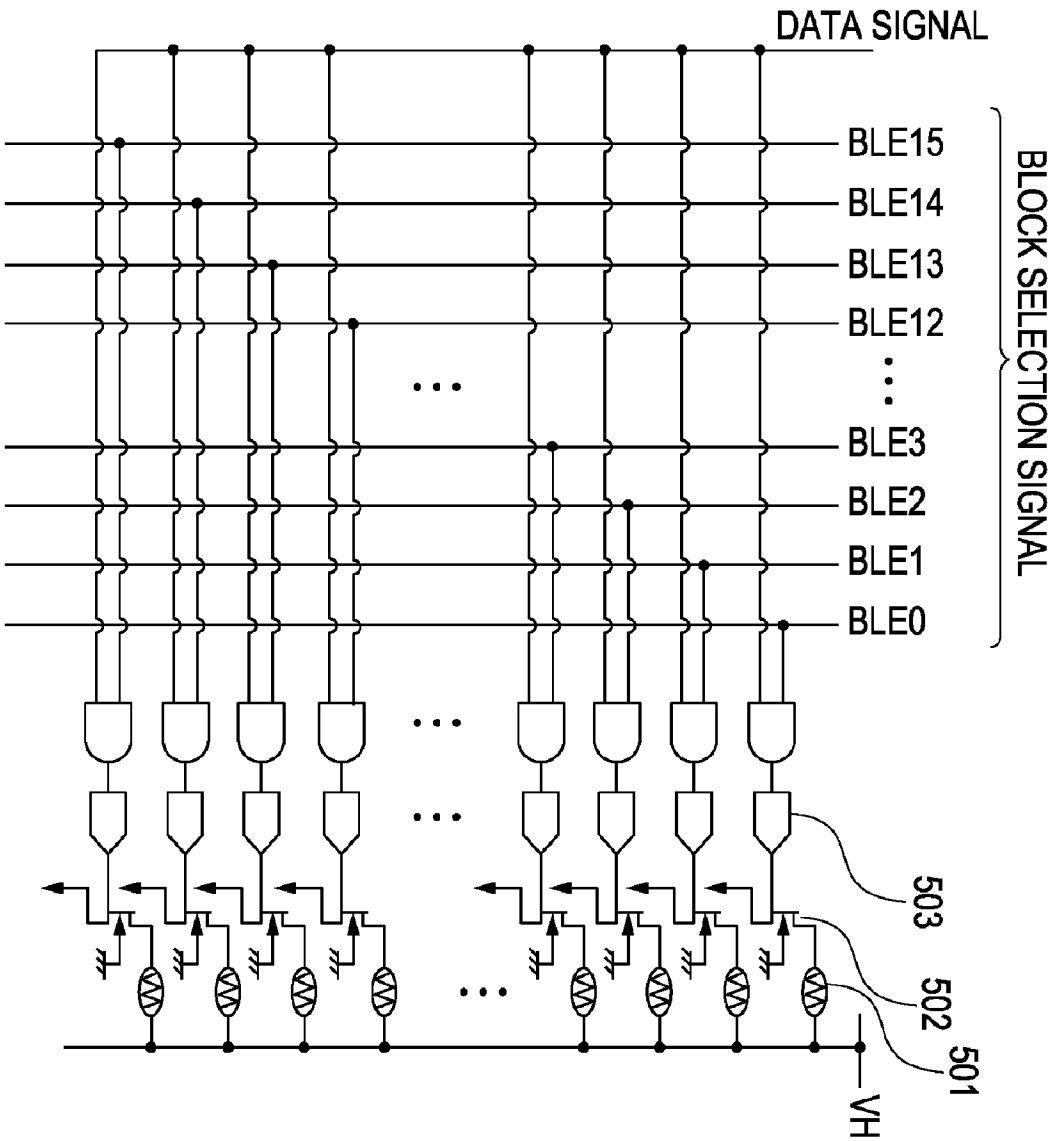
FIG. 10 is a table of inversed BE truth values in the first embodiment.

FIG. 10 is an equivalent circuit diagram of driver sections in the adjacent 16 segments. As a DATA signal, any of DATA0 to DATA15 described above is input. The signals BLE0 to BLE15 are sequentially connected to the adjacent 16 segments. In a segment in which the DATA signal and the BLE signal simultaneously become high, the levels of signals are increased by a level converter 503, so that a driver transistor 502 is driven and current flows through a heater 501.

Referring again to FIG. 6, an INV terminal is a signal terminal for logically inverting the BE signal, and XORs the BE signal. The INV terminal is normally low because it is pulled down. In a state in which nothing is connected to the INV terminal, the BE signal enters the decoder without changing the logic, as shown in FIG. 9. When the INV terminal is made high by being connected to VDD, the BE signals is logically inverted and then enters the decoder, as show in FIG. 9.

Figure 3A:
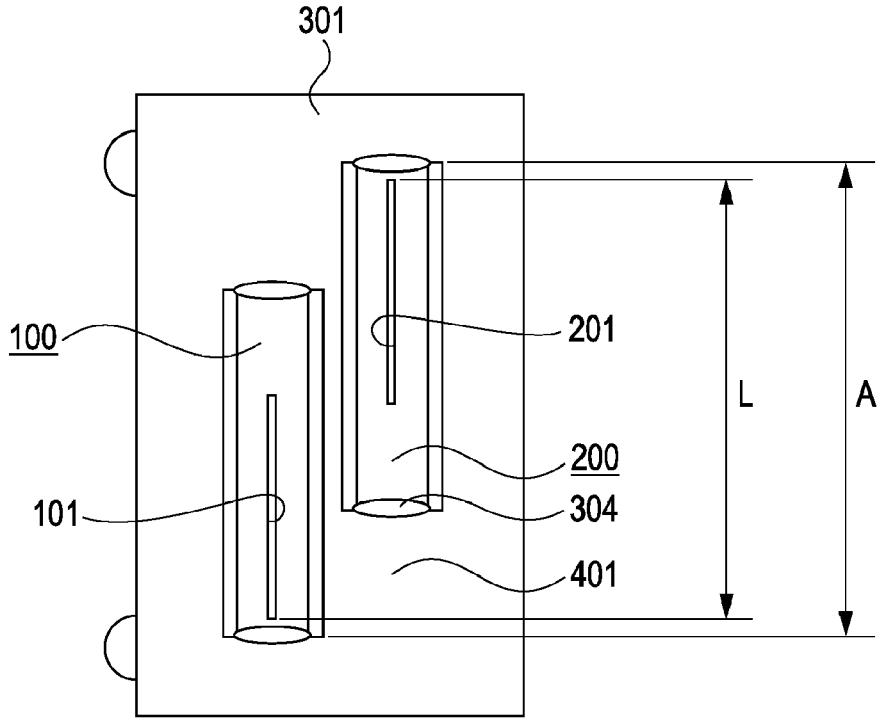
FIGS. 3A and 3B are schematic views of the recording head of the first embodiment, as viewed from a discharge port side.

FIG. 3A is a schematic view of the liquid-discharging recording head in which two substrates (first substrate 100 and second substrate 200) are provided on the support member 301. The substrates 100 and 200 are arranged in the longitudinal direction thereof so that regions at the ends of the substrates overlap in a direction orthogonal to the longitudinal direction. In sealing regions 304, the pads 104*b* shown in FIG. 5A and lines to be connected to the pads 104*b* are sealed by a sealant.

The substrate 100 is oriented in the same direction as that of the substrate 100 shown in FIG. 5A, and the substrate 200 is turned 180 degrees from the substrate 100. In other words, in the substrate 100 shown in FIG. 3A, the supply port 101 is offset toward the lower side (toward one side of the support member 301) in the longitudinal direction of the substrate 100. Further, a shift register (S/R) 105, a latch circuit (LT) 106, etc. are provided in a side where a region between the end of the supply port 101 and the end of the substrate 101 is wider (on the upper side in FIG. 3A; at the other side opposite the one side). In contrast, in the substrate 200, a supply port 201 is offset toward the upper side (toward the other side) in FIG. 3A, and a shift register (S/R) 105, a latch (LT) circuit 106, etc. are provided on the lower side (on the one side) of the supply port 201.

From another viewpoint, the distance between an end of the supply port 101 in the substrate 100 (first substrate) on the one side and an end of the substrate 100 on the one side is shorter than the distance between an end of the supply port 101 on the other side and an end of the substrate 100 on the other side. Further, the distance between an end of the supply port 201 in the substrate 200 (second substrate) on the other side and an end of the substrate 200 on the other side is shorter than the distance between an end of the supply port 201 on the one side and an end of the substrate 200 on the one side.

Figure 4:
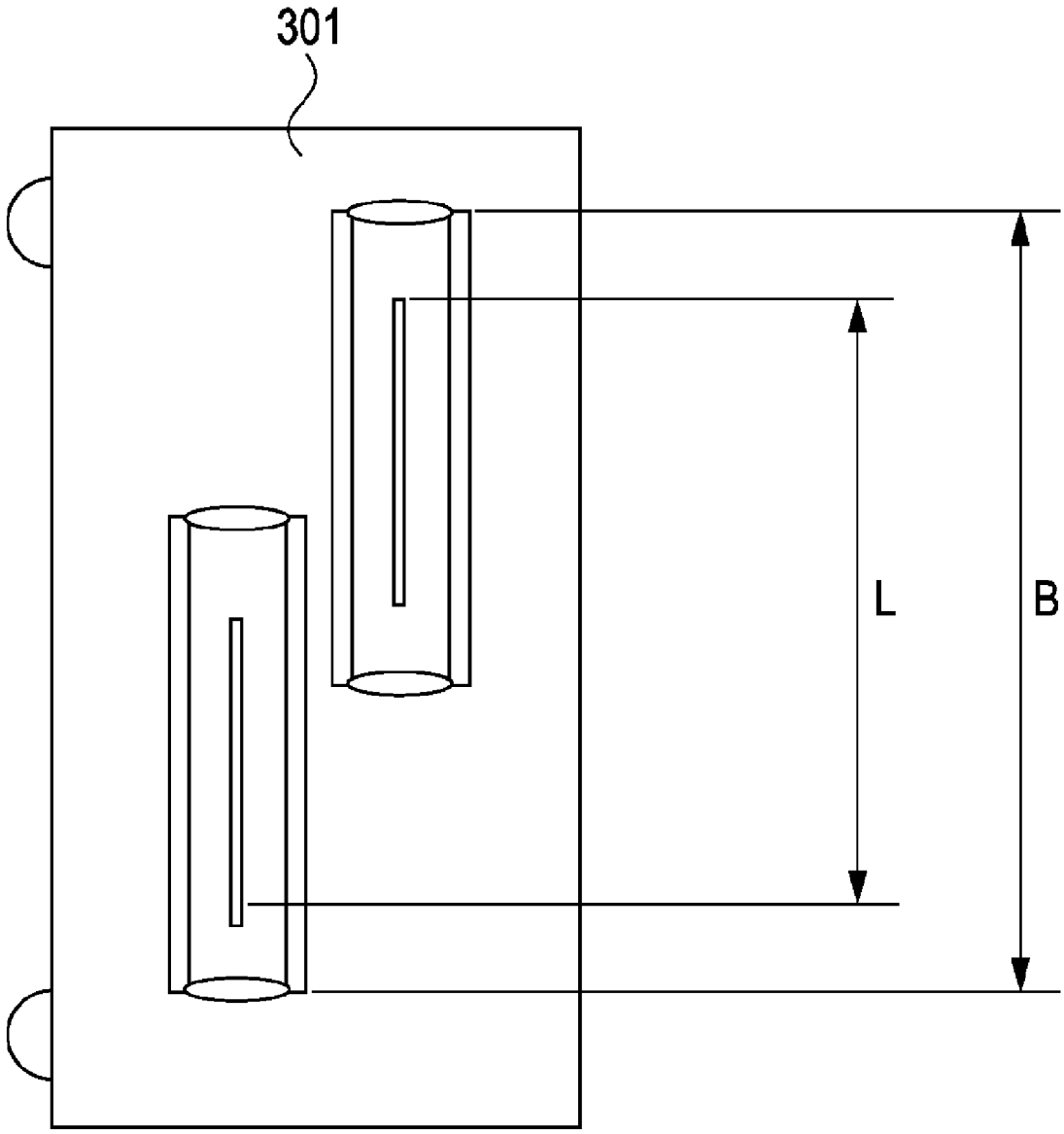
FIG. 4 is a schematic view of a recording head of the related art, as viewed from a discharging port side.

A structure shown in FIG. 4 will now be described as a comparative example. In the structure shown in FIG. 4, two substrates each having an ink supply port in the center thereof are arranged on a support member, unlike the structure adopted in the first embodiment of the present invention. Compared with the first embodiment shown in FIG. 3A, the printable area length L is substantially equal in both the structures, but the overall longitudinal substrate length A in the first embodiment is smaller than the overall longitudinal substrate length B in the comparative example. As described above, in the first embodiment, the supply port is offset in the longitudinal direction of the substrate, and the side where the region between the end of the supply port and the end of the substrate is wider is close to the center of the support member. In other words, when a plurality of substrates are arranged on the support member, in the substrates provided at both ends in the arrangement direction, the side where the region between the end of the supply port and the end of the substrate is narrower is close to the end of the support member. Since this can reduce the sizes of the support member 301 and the TAB 401 serving as mounted components, the size of the head itself can be reduced, and cost reduction is achieved.

In the substrate 200, the BE signal is inverted by connecting the INV terminal 110 to VDD. Referring to FIG. 8, when a signal input to DECODER is inverted, the order is reversed, that is, BLE15 becomes high at a position where BLE0 is high, and BLE14 becomes high at a position where BLE1 is high.

Since the substrate 200 is turned 180 degrees, as a result, the order of time division driving becomes the same as that of the substrate 100. Hence, the apparatus can control printing without any attention to a gap in the time division timing due to inversion of the substrate. This allows the landing positions of dots printed by the substrate 100 to be easily aligned with the landing positions of dots printed by the substrate 200 in so-called multi-pass printing in which pixels are formed by a plurality of scanning operations. As a result, a good print result can be obtained.

Figure 13:
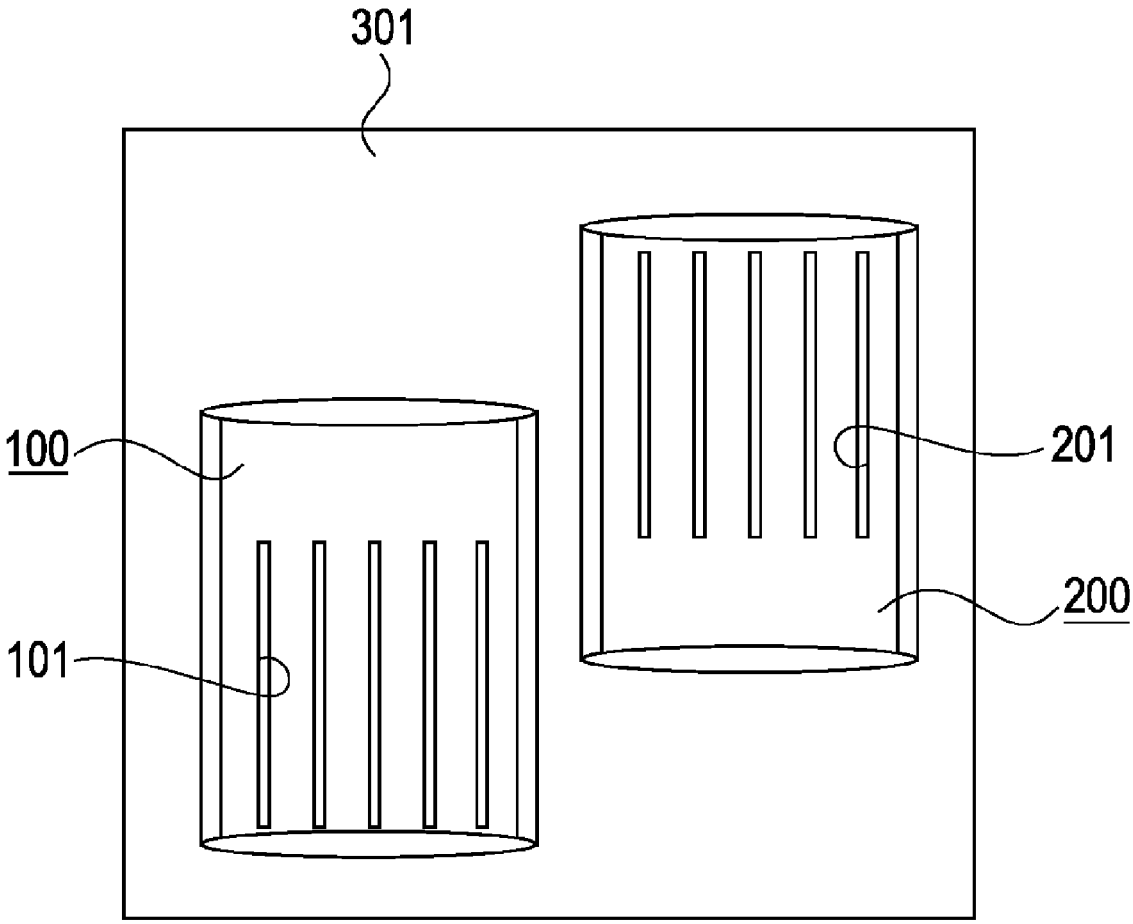
FIG. 13 is a schematic view of a recording head according to a second embodiment of the present invention, as viewed from a discharging port side.

A second embodiment will now be described with reference to FIG. 13. Components substantially identical to those adopted in the above-described first embodiment are denoted by the same reference numerals, and descriptions thereof are omitted.

In the second embodiment, a substrate 100 and a substrate 200 include five ink supply ports 101 and five ink support ports 201, respectively. Each of the ink supply ports is offset toward one longitudinal side of the substrate. The advantages of the present invention can also be obtained in such a case in which each substrate includes a plurality of supply ports. In other words, when a plurality of substrates are arranged on a support member, in the substrates provided at both ends in the arrangement direction, a side where a region between the end of the supply port and the end of the substrate is narrower is close to the end of the support member. Since the sizes of a support member 301 and a TAB 401 serving as mounted components can be thereby reduced, the size of the head itself is reduced, and this can achieve size reduction.

Figure 14:
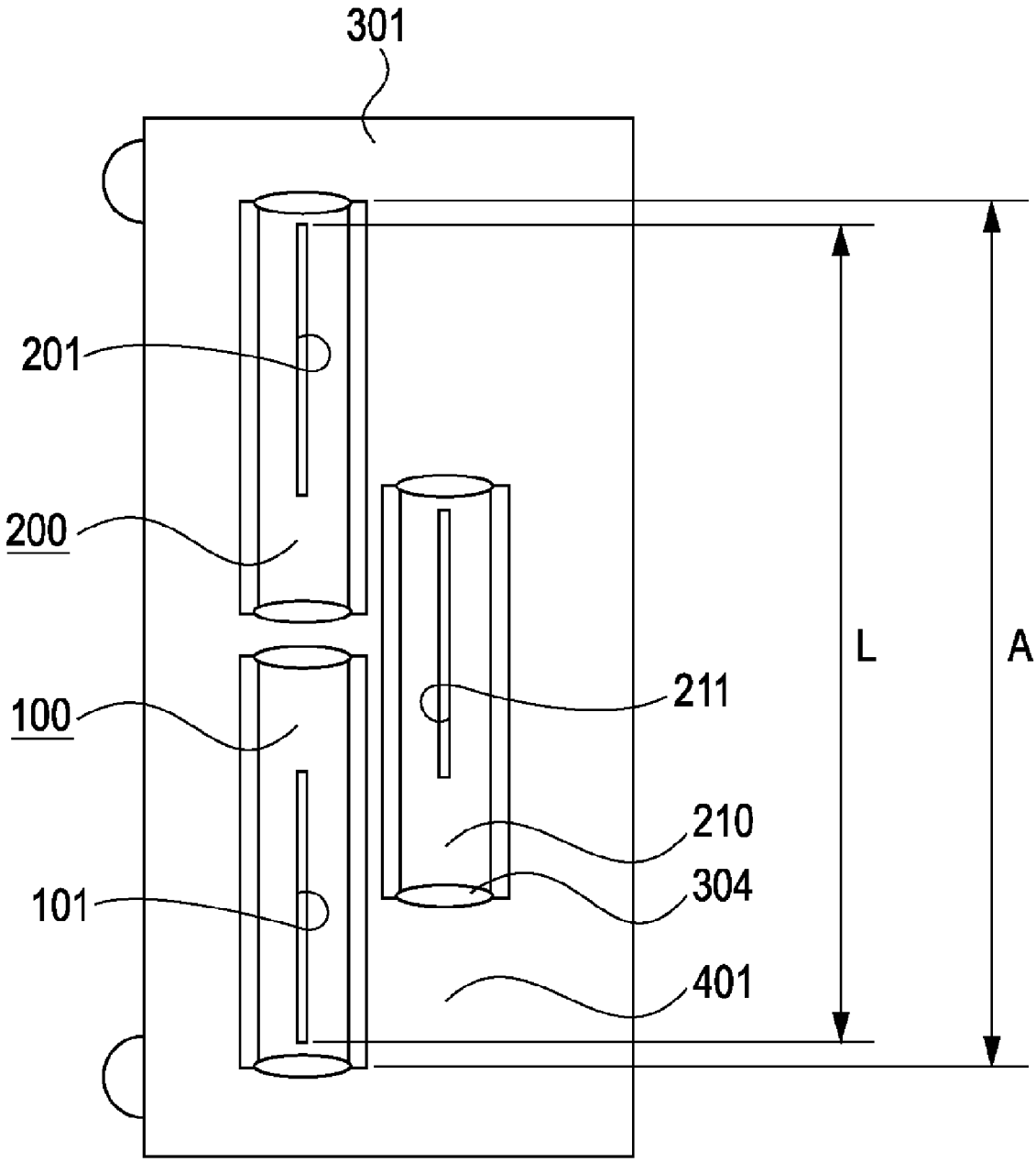
FIG. 14 is a schematic view of a recording head according to a third embodiment of the present invention, as viewed from a discharging port side.

A third embodiment will now be described with reference to FIG. 14. Components substantially identical to those adopted in the above-described embodiments are denoted by the same reference numerals, and descriptions thereof are omitted.

In a recording head according to the third embodiment, three substrates (a first substrate 100 having a supply port 101, a second substrate 200 having a supply port 201, a third substrate 210 having a supply port 211) are arranged on a support member 301 in the longitudinal direction of the substrates. In the third embodiment, an ink supply port in each of the substrates is offset toward one longitudinal side of the substrate.

Similarly to the above-described embodiments, of a plurality of substrates arranged on the support member 301, the substrates 100 and 200 at both ends of the arrangement are each arranged so that a side where a region between the end of the supply port and the end of the substrate is narrower is close to the end of the substrate. For this reason, similarly to the above-described embodiment, the total substrate length A can be decreased without reducing the printable area. Thus, it is possible to limit the total size of the recording head and to reduce the cost.

In the present invention, when a plurality of substrates are arranged on the support member, the substrates provided at both ends in the arrangement direction are provided so that the side where the region between the end of the supply port and the end of the substrate is narrower is close to the end of the support member. In contrast, in a substrate or substrates other than the substrates at both ends (e.g., the third substrate 210 in the third embodiment), the supply port does not always need to be offset in the substrate. That is, similar advantages can be obtained even when the supply port is provided at almost the longitudinal center of the substrate, as in the related art.

The present invention is not limited to the third embodiment, and also includes a case in which four or more substrates are provided on the support member 301. In this case, in substrates other than the substrates at both ends, a supply port may be provided offset in the longitudinal direction of the substrate or may be provided in the center of the substrate.

When the supply port is provided in the center of the substrate, particularly when a plurality of, for example, eight substrates are provided, it is possible to share substrates other than substrates provided at both ends, and this is preferable in terms of production cost.

When recording is performed by discharging ink from the recording head, the temperature of the center region of the support member generally tends to become higher than the temperature of the end regions. For this reason, in the substrates other than the substrates at both ends, of a plurality of substrates, it is preferable that a wider region between the supply port and the end of the substrate be close to the longitudinal end of the support member. This can reduce the above-described increase in temperature in the center region of the support member.

In any of the embodiments, there is no dimensional restrictions on the mounted components even when the wider region (length) at the end of the substrate is further enlarged. Therefore, it is preferable that the circuit sections, which need a relatively large area in the substrate, concentrate in the wider end region. To reduce the size of the recording head, it is preferable that not only the shift register and the decoder described in the above embodiments, but also a LVDS circuit for high-speed signal transfer, a fuse ROM in which driving parameters are written, and a constant-current driving circuit concentrate in the wider end region.

Figure 3B:
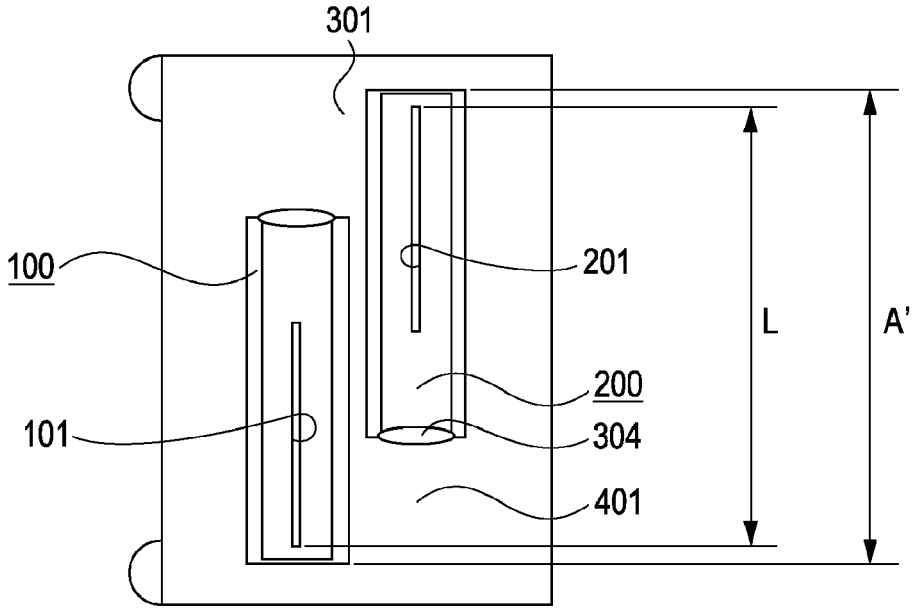
Figure 5B:
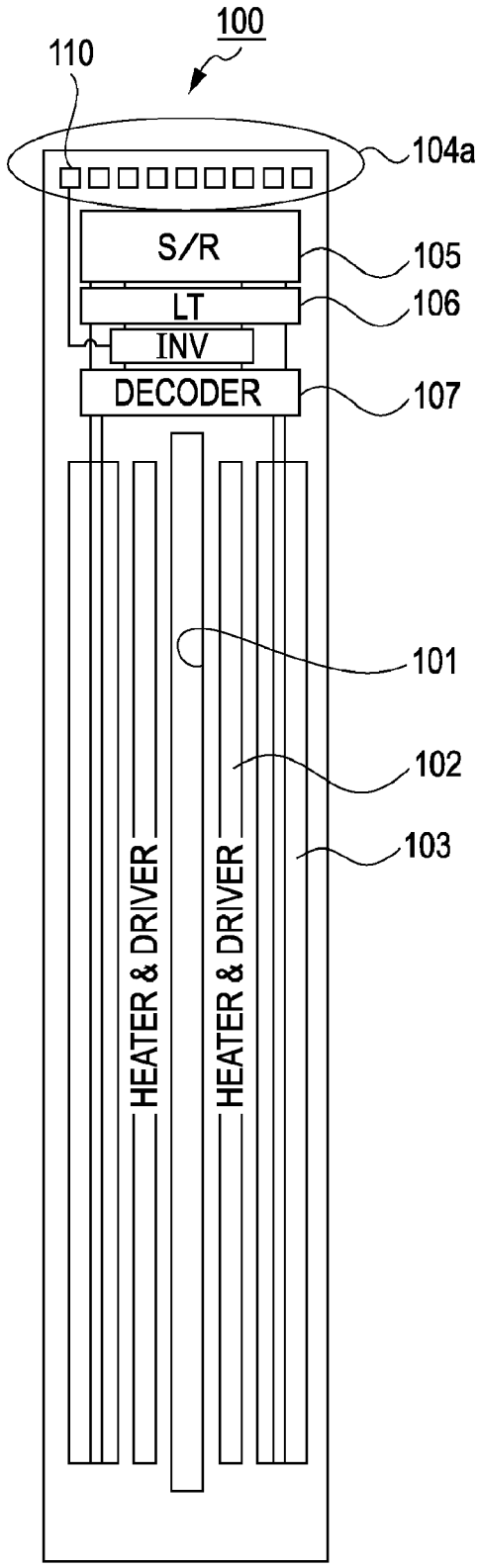

In any of the embodiments, a head shown in FIG. 3B can be configured using substrates in which only pads 104*a* are provided in a wider end region of the substrate, as shown in FIG. 5B. Since the region for the pads 104*b* in FIG. 5A is not provided, the total substrate length A' can be shortened further.

While all the shift register 105, the latch circuit 106, and the decoder 107 are provided in the wider region between the end of the supply port and the end of the substrate in the above-described embodiments, the present invention is not limited thereto. That is, the present invention is also applicable to a case in which any of the shift register 105, the latch circuit 106, and the decoder 107 is provided in the narrower region between the end of the supply port and the end of the substrate.

Recording Apparatus

Figure 11:
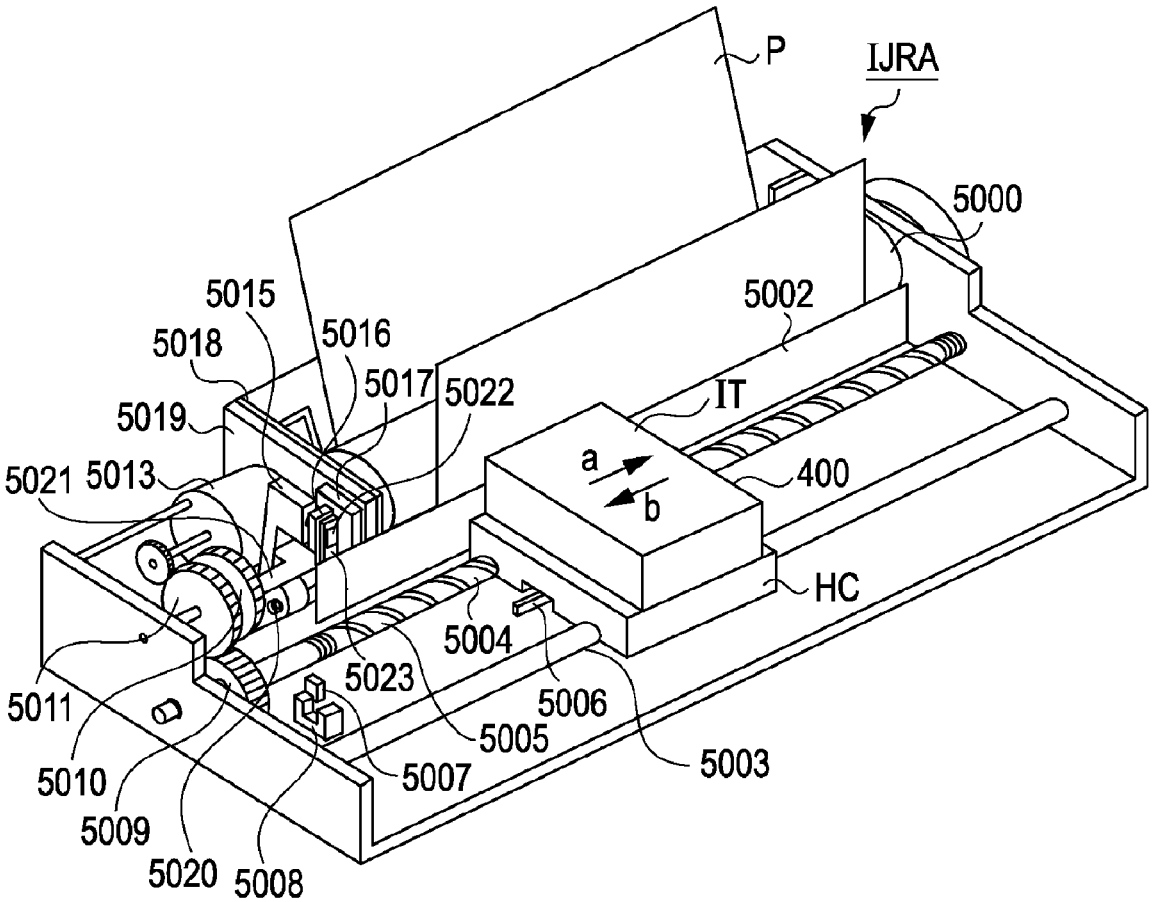
FIG. 11 is a general view of a recording apparatus according to an embodiment of the present invention.

A brief description will be given below of an inkjet recording apparatus IJRA in which the inkjet recording head 400 of the present invention can be mounted. Referring to FIG. 11, a lead screw 5004 rotates via driving-force transmission gears 5011 and 5009 in association with forward and reverse rotations of a driving motor 5013. A carriage HC has a pin (not shown) engaged with a spiral groove 5005 of the lead screw 5004, and is caused by the rotation of the lead screw 5004 to reciprocate along a guide rail 5003 in the directions of arrows a and b. An inkjet recording head 400 is mounted on the carriage HC. An ink tank IT is connected to the inkjet recording head 400.

A paper presser plate 5002 presses paper P against a platen 5000 through the moving direction of the carriage HC. Photosensors 5007 and 5008 serve as home-position detecting members for checking the presence of a lever 5006 of the carriage HC in this region and for switching the rotating direction of the motor 5013. A support member 5016 supports a cap member 5022 that puts on a cap on the front face of the recording head 400. A suction member 5015 sucks from the cap so as to conduct suction recovery on the recording head 400 via an in-cap opening 5023. A moving member 5019 moves a cleaning blade 5017 in the front-rear direction, and the moving member 5019 and the cleaning blade 5017 are supported on a main-body support plate 5018. A known cleaning blade can be applied to the cleaning blade 5017 in the third embodiment. A lever 5021 is used to start suction in suction recovery. The lever 5021 moves with the movement of a cam 5020 engaged with the carriage HC, and the driving force of the driving motor 5013 is controlled by a known transmission method, such as switching of a clutch circuit, via a gear 5010.

These capping, cleaning, and suction recovery operations are desirably performed at corresponding positions by the action of the lead screw 5004 when the carriage HC reaches a region near the home position. However, in any of the embodiments, the operations can be desirably performed at a known timing.

Figure 12:
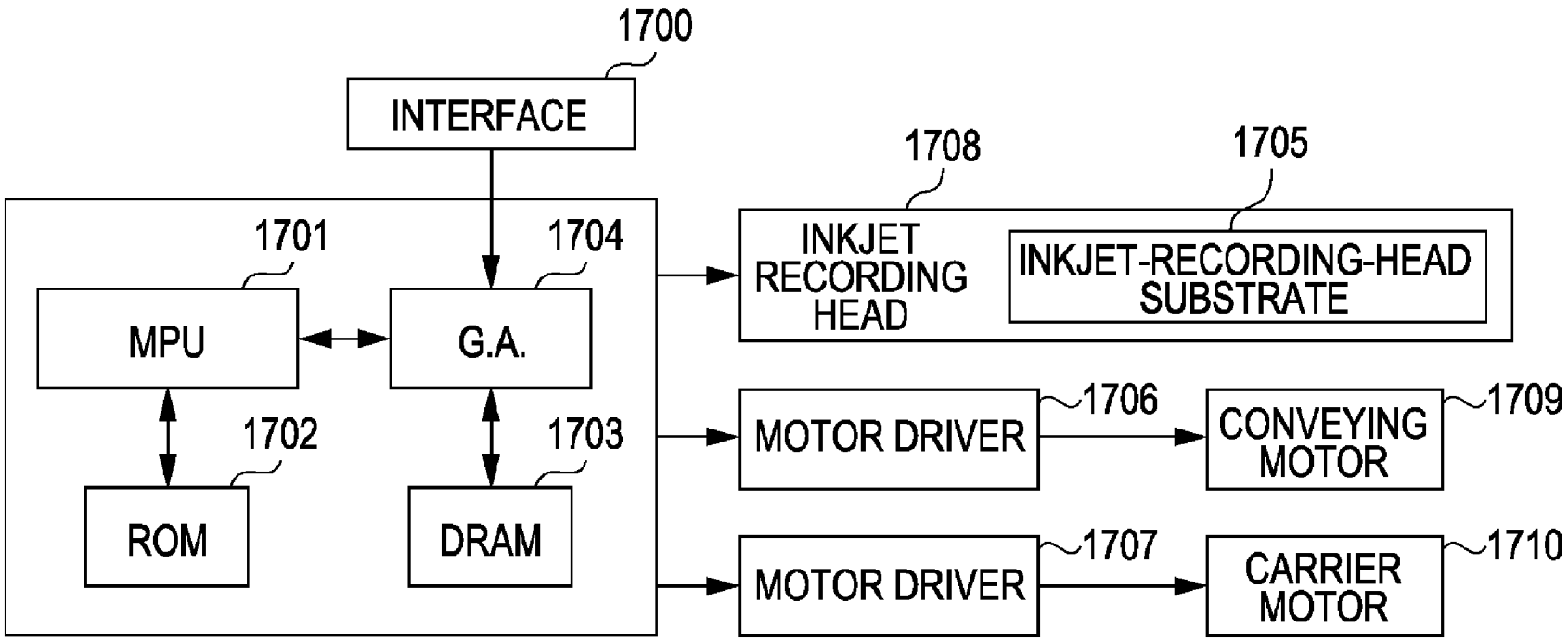
FIG. 12 is a block diagram showing a control configuration of the recording apparatus in the embodiment.

A control configuration for controlling recording of the above-described inkjet recording apparatus will now be described with reference to FIG. 12 serving as a block diagram of a control circuit. The control circuit shown in FIG. 12 includes an interface 1700 to which a recording signal is input, a MPU 1701, a program ROM 1702 that stores a control program to be executed by the MPU 1701, a dynamic RAM 1703 (hereinafter referred to as a DRAM) that stores various data (the recording signal and recording data to be supplied to the head), and a gate array 1704 that controls the supply of recording data to a recording head 1708. Signals for driving the recording head 1708 are supplied via the gate array 1704. The gate array 1704 also controls data transfer among the interface 1700, the MPU 1701, and the DRAM 1703.

A carrier motor 1710 carries the recording head 1708, and a conveying motor 1709 conveys a recording sheet. An inkjet recording head substrate 1705 is provided in the recording head 1708, and includes heaters for ink discharging and driving circuits therefor. Motor drivers 1706 and 1707 drive the conveying motor 1709 and the carrier motor 1710, respectively.

In the above-described control configuration, when a recording signal is input to the interface 1700, it is converted into recording data for printing between the gate array 1704 and the MPU 1701. Then, the motor drivers 1706 and 1707 are driven, and the ink discharging heaters are driven according to the recording data supplied to the inkjet recording head substrate 1705 in the recording head 1708, so that printing is performed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-155355 filed Jun. 13, 2008, which is hereby incorporated by reference herein in its entirety.

What is claimed is:

1. A liquid-discharging recording head comprising:

two substrates each including an energy generating element configured to generate energy used to discharge liquid and a supply port configured to supply the liquid to the energy generating element; and a support member on which the substrates are arranged to extend along each other in a longitudinal direction, wherein the substrates include a first substrate provided on one side of the support member in the longitudinal direction, and a second substrate provided on an other side of the support member opposite the one side in the longitudinal direction, wherein a region of the first substrate on the other side overlaps with a region of the second substrate on the one side in a direction intersecting the longitudinal direction, wherein a distance between an end of the supply port in the first substrate on the one side in the longitudinal direction and an end of the first substrate on the one side is smaller than a distance between an end of the supply port in the first substrate on the other side in the longitudinal direction and an end of the first substrate on the other side, wherein a distance between an end of the supply port in the second substrate on the other side in the longitudinal direction and an end of the second substrate on the other side is smaller than a distance between an end of the supply port in the second substrate on the one side in the longitudinal direction and an end of the second substrate on the one side, and wherein a region between the end of the supply port in the first substrate on the other side in the longitudinal direction and the end of the first substrate on the other side and a region between the end of the supply port in the second substrate on the one side in the longitudinal direction and the end of the second substrate on the one side each includes a driving circuit configured to drive the energy generating element.

2. The liquid-discharging recording head according to claim 1, wherein the driving circuit includes a shift register and a latch circuit.

3. A liquid-discharging recording head comprising:

at least three substrates each including an energy generating element configured to generate energy used to discharge liquid and a supply port configured to supply the liquid to the energy generating element; and a support member on which the substrates are arranged to extend along one another in a longitudinal direction, wherein the substrates include a first substrate provided on one side of the support member in the longitudinal direction, and a second substrate provided on an other side of the support member opposite the one side in the longitudinal direction, wherein a distance between an end of the supply port in the first substrate on the one side in the longitudinal direction and an end of the first substrate on the one side is smaller than a distance between an end of the supply port in the first substrate on the other side in the longitudinal direction and an end of the first substrate on the other side, wherein a distance between an end of the supply port in the second substrate on the other side in the longitudinal direction and an end of the second substrate on the other side is smaller than a distance between an end of the supply port in the second substrate on the one side in the longitudinal direction and an end of the second substrate on the one side, and wherein a region between the end of the supply port in the first substrate on the other side in the longitudinal direction and the end of the first substrate on the other side and a region between the end of the supply port in the second substrate on the one side in the longitudinal direction and the end of the second substrate on the one side each includes a driving circuit configured to drive the energy generating element.

4. The liquid-discharging recording head according to claim 3, wherein a third substrate is provided between the first substrate and the second substrate in the longitudinal direction on the support member.

5. The liquid-discharging recording head according to claim 4, wherein a distance between an end of a supply port in the third substrate on the other side and an end of the third substrate on the other side is equal to a distance between an end of the supply port in the third substrate on the one side and an end of the third substrate on the one side.

6. The liquid-discharging recording head according to claim 4, wherein a distance between an end of a supply port in the third substrate on the other side and an end of the third substrate on the other side is different from a distance between the supply port in the third substrate on the one side and an end of the third substrate on the one side.

7. The liquid-discharging recording head according to claim 6, wherein the supply port in the third substrate is offset toward one of the one side and the other side where the distance between the end of the third substrate and the end of the support member is shorter.

* * * * *